US007207276B1

(12) United States Patent
Dindl

(10) Patent No.: US 7,207,276 B1
(45) Date of Patent: Apr. 24, 2007

(54) NON-LETHAL AMMUNITION UTILIZING A DENSE POWDER BALLAST AND A TWO-STAGE FIRING SEQUENCE

(75) Inventor: Frank Dindl, Newton, NJ (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 451 days.

(21) Appl. No.: 10/711,121

(22) Filed: Aug. 25, 2004

(51) Int. Cl.
*F42B 8/00* (2006.01)

(52) U.S. Cl. ..... 102/502; 102/444; 102/443; 102/447

(58) Field of Classification Search ..... None
See application file for complete search history.

(56) References Cited

U.S. PATENT DOCUMENTS

| | | | | |
|---|---|---|---|---|
| 1,920,075 | A * | 7/1933 | Haenichen | 102/443 |
| 3,090,309 | A * | 5/1963 | Burns, Jr. | 102/444 |
| 3,349,707 | A * | 10/1967 | Wortley, Jr. et al. | 102/346 |
| 3,435,769 | A * | 4/1969 | Germershausen | 102/529 |
| 3,517,619 | A * | 6/1970 | Niemann | 102/529 |
| 3,570,406 | A * | 3/1971 | Frey et al. | 102/529 |
| 3,724,378 | A * | 4/1973 | Knight et al. | 102/456 |
| 4,716,835 | A * | 1/1988 | Leemans | 102/529 |
| 5,247,889 | A * | 9/1993 | Luebbers | 102/444 |
| 5,375,529 | A * | 12/1994 | Knight et al. | 102/513 |
| 6,324,984 | B1 * | 12/2001 | Dindl | 102/447 |
| 6,722,283 | B1 * | 4/2004 | Dindl et al. | 102/489 |
| 7,021,219 | B1 * | 4/2006 | Dindl | 102/447 |
| 7,025,001 | B2 * | 4/2006 | Brunn | 102/502 |
| 2005/0183612 | A1 * | 8/2005 | Huffman | 102/434 |

* cited by examiner

*Primary Examiner*—Michelle Clement
(74) *Attorney, Agent, or Firm*—Michael C. Sachs

(57) ABSTRACT

A non-lethal ammunition utilizes dense powder ballast and a two-stage firing sequence for launching non-lethal projectiles of a caliber range from approximately 5.56 mm through approximately 40 mm. The non-lethal ammunition comprises a non-lethal cartridge. The non-lethal cartridge comprises a dense powder ballast and one or more non-lethal projectiles. The dense powder ballast is more massive than the non-lethal projectile providing sufficient payload mass to operate the weapon mechanism while launching the non-lethal projectile at velocities compatible with non-lethal applications. A two-stage ignition system fires the non-lethal ammunition and subsequently fires the more massive dense powder ballast. The firing events are separated by a time delay of less than a second. The non-lethal ammunition provides non-lethal projectile capability for semi-automatic and automatic weapons. Rifling imparts sufficient spin to the ballast material to efficiently disperse the dense powder upon muzzle exit and decelerate the ballast cup and contents to an "eye safe" non-lethal velocity at the target. The cartridge case may be smooth bore for use in rifled barrels, or may be rifled for use in smooth bore barrels.

6 Claims, 3 Drawing Sheets

Figure 1:
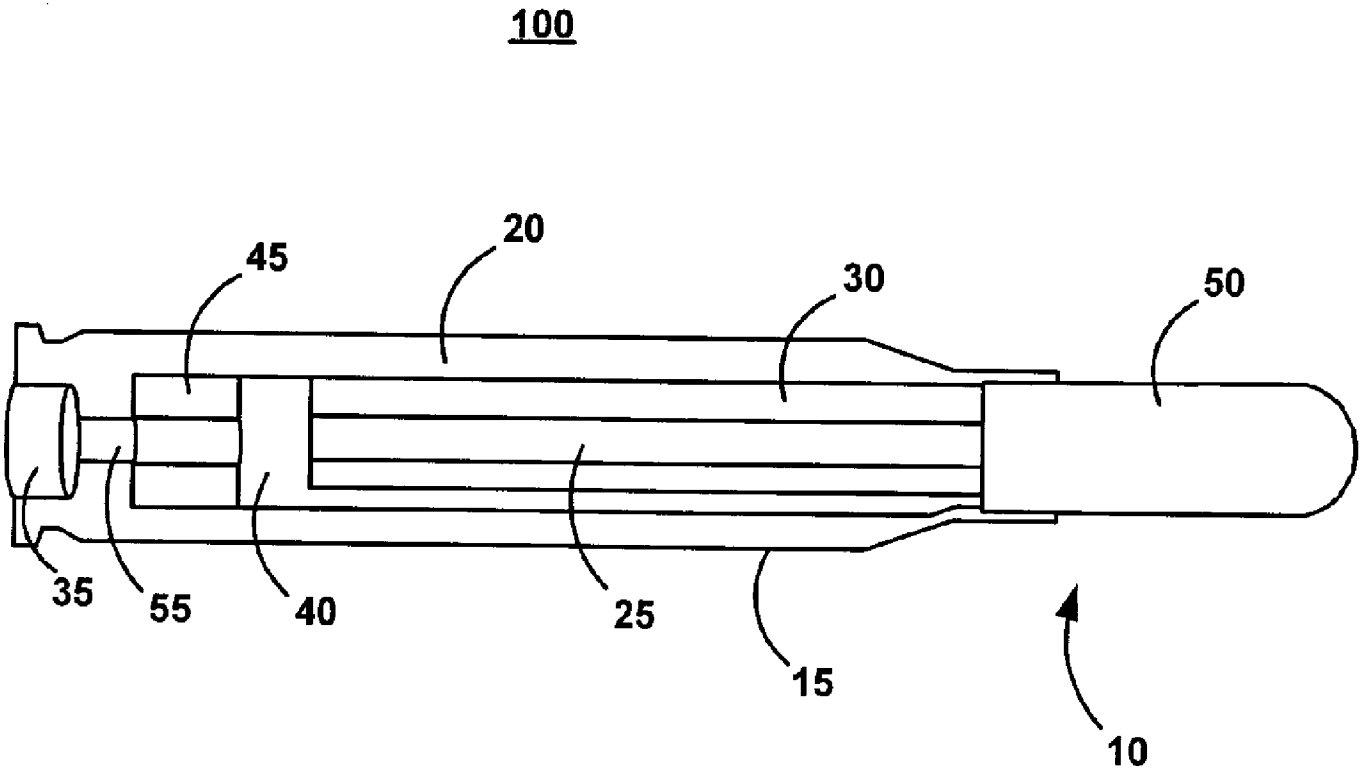

NON-LETHAL AMMUNITION UTILIZING A DENSE POWDER BALLAST AND A TWO-STAGE FIRING SEQUENCE

The inventions described herein may be manufactured, used and licensed by or for the U.S. Government for U.S. Government purposes.

The present invention generally relates to non-lethal ammunition. More specifically, the present invention relates to non-lethal ammunition comprising a projectile and a dense powder ballast that achieves trajectory compatible with conventional combat ammunition and a recoil impulse with associated bore pressure that is able to power automatic and semi-automatic weapons.

Non-lethal ammunition is used in military and civilian applications for training, crowd control, target practice, etc. Desired characteristics of such non-lethal ammunition are that the non-lethal ammunition is ballistically similar to live ammunition, capable of being fired accurately over a range of applicable distances, and capable of being packaged as a self-loading round in automatic and semi-automatic weapons. In addition, non-lethal ammunition should maintain a low penetrating capacity and be 'eye safe'. Further, non-lethal ammunition should be compatible with a number of automatic and semi-automatic weapons.

One conventional non-lethal ammunition or projectile is a full caliber or near full caliber non-lethal ammunition projectile utilizing a frangible outer projectile casing that fragments upon exiting the muzzle of a firearm. Fragmenting the projectile on exit from the muzzle reduces the mass of the targeting projectile for low penetrating capacity in non-lethal ammunition. The total mass and associated momentum of the projectile is sufficient to ensure the operation of the self-loading function of the firearm.

As the projectile travels down the rifled barrel of the firearm, the outer surface of the projectile comes into contact with the barrel, inducing projectile spin and weakening the frangible outer projectile casing. The spin stabilizes the projectile during flight. Although this technology has proven to be useful, the accuracy of the projectile can be improved by a ballistically stable mass and geometry. The consistency of the ballistic characteristics of the projectile is compromised by unpredictable disintegration of the frangible outer projectile casing. The ballistic characteristics of the projectile are further compromised by the residual filling content that becomes a part of the projectile upon exit from the gun muzzle.

Another conventional non-lethal projectile comprises a full-bore projectile body fitted with a compliant nose. This compliant nose compresses to absorb energy upon impact, reducing the likelihood of skin abrasion, laceration, skeletal or organ damage. The majority of the non-lethal projectile body is hollow. This allows a concentration of the projectile mass near the outer diameter, resulting in additional gyroscopic stability.

The propulsion system of this conventional non-lethal projectile utilizes a modern smokeless propellant that is burned at a higher pressure and controllably vented into the weapon chamber to work upon the projectile base. This high-low pressure technique provides greater consistency in muzzle velocity when compared to a conventional single-stage propulsion system producing similar ballistics. This combination allows a modern smokeless propellant to launch a low mass projectile at a greatly reduced velocity. Although this technology has proven to be useful at larger calibers, a non-lethal projectile with similar advantages is desired at smaller calibers.

A further conventional non-lethal projectile comprises a non-lethal shotgun round with a plastic hull inserted into a metal base to form a round casing. This non-lethal shotgun round utilizes a conventional single stage firing system. A propellant charge in the base propels a non-lethal projectile comprising an elastomeric bag filled with a packed particulate load. The elastomeric bag ruptures on impact, dispersing the packed particulate matter. This non-lethal projectile is designed to work with standard shotguns or shotgun-like firearms, such as, for example, the 37/38/40 mm gas gun grenade launcher. Although this technology has proven to be useful, it is desirable to present additional improvements in projectiles for smaller caliber weapons.

Non-lethal projectiles are typically launched with a kinetic energy that produces non-lethal effects on target impact. Existing semi-automatic and automatic weapons such as, for example, semi-automatic shotguns, 40 mm grenade machine guns, the Objective Crew Served Weapon, the Objective Individual Combat Weapon, etc., are designed to fire projectiles with kinetic energies far greater than non-lethal projectiles of the same caliber. The weapon operating systems are designed to function with projectiles that have a specific minimum ammunition impulse.

Dense powder ballast has recently been used to launch non-lethal projectiles from semi-automatic and automatic weapons. These applications require launching the dense powder ballast with the non-lethal payload. This limits the non-lethal projectile muzzle velocity to the same muzzle velocity as the dense powder ballast. However, many weapon mechanisms require relatively high ammunition impulses to function in the semi-automatic or automatic mode. In applications where the payload volume is relatively small (i.e., small caliber ammunition), the relatively small volume available for ballast requires unacceptably high muzzle velocities for non-lethal applications.

Consequently, there is a great and still unsatisfied need for non-lethal ammunition for weapons such as, for example, semi-automatic shotguns, the Objective Individual Combat Weapon, the Objective Crew Served Weapon, the 40 mm MK19 grenade machine gun, etc. What is needed is a non-lethal ammunition design in which the recoil impulse and trajectory of the non-lethal ammunition is compatible with the standard combat ammunition recoil impulse and trajectory for a range of calibers. The non-lethal ammunition should be full caliber, capable of stable ballistics, and low in penetration capacity to minimize bodily injuries. Further, the non-lethal ammunition should be capable of self-reloading in automatic and semi-automatic weapons.

The non-lethal ammunition should be compatible with several conventional weapons at a range of calibers including self-loading automatic and semi-automatic weapons. The non-lethal ammunition should be capable of loading and reloading without any modifications to the weapon in either indoor or outdoor environments. The need for such a non-lethal ammunition has heretofore remained unsatisfied.

The present invention satisfies this need, and presents a non-lethal ammunition utilizing dense powder ballast and a two-stage firing sequence for launching non-lethal projectiles (referenced herein as the non-lethal ammunition). The non-lethal ammunition provides a unified approach to address both the small caliber and large caliber non-lethal ammunitions, covering a range from approximately 5.56 mm through approximately 40 mm that includes many weapons not limited to the following examples. The 5.56 mm caliber version of the non-lethal ammunition can be used by the M16 and M4 family of weapons and provides full weapon cycling capability without modifications. The 40 mm caliber version of the non-lethal ammunition can be used by the MK19 and MK47 family of weapons.

The non-lethal ammunition comprises a non-lethal cartridge. The non-lethal cartridge comprises a dense powder ballast and one or more non-lethal projectiles. The dense powder ballast is more massive than the non-lethal projectile. The dense powder ballast and non-lethal projectile provide sufficient payload mass and associated momentum to operate the weapon mechanism while launching the non-lethal projectile at velocities compatible with non-lethal applications. A two-stage ignition system fires the non-lethal ammunition first and subsequently fires a dense powder ballast that is significantly more massive than the non-lethal ammunition. The firing events are separated by a time delay of less than a second.

In small caliber weapons, the non-lethal ammunition provides a recoil impulse and trajectory compatible with conventional small caliber combat ammunition comprising, for example, 5.56 mm and 9 mm. The non-lethal ammunition utilizes a non-lethal cartridge with a two-stage ignition system. The two-stage ignition system initially launches the non-lethal projectile at a low velocity. After a short time delay, the dense powder ballast is launched at a significantly higher velocity with sufficient momentum to cycle the reloading mechanism in the firing weapon.

Rifling in the barrel of the weapon imparts spin to the non-lethal projectile and dense powder ballast. Alternatively, the cartridge case may be rifled to impart spin to the non-lethal payload and dense powder ballast payload when fired from smooth bore weapons. The dense powder ballast achieves sufficient spin to efficiently disperse the dense powder ballast upon muzzle exit and decelerate the dense powder ballast to an "eye safe" non-lethal velocity at the target.

The non-lethal ammunition provides non-lethal projectile capability for semi-automatic and automatic weapons such as, for example, the Objective Individual Combat Weapon, 25 mm Objective Crew Served Weapon, 40 mm MK19 grenade launcher, 12 gauge semi-automatic shotguns, and other semi-automatic and automatic weapons of other calibers while producing non-lethal effects at the target.

Figure 2:
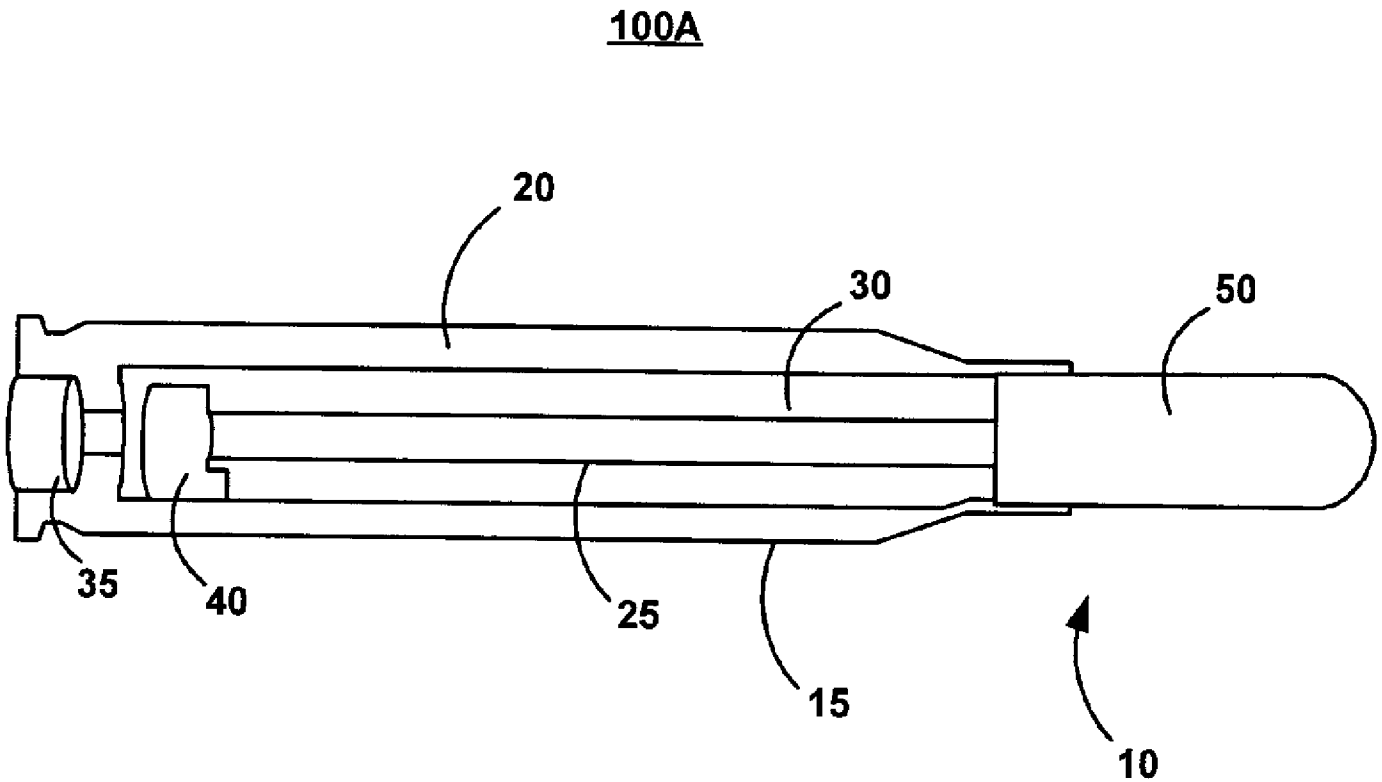
Figure 3:
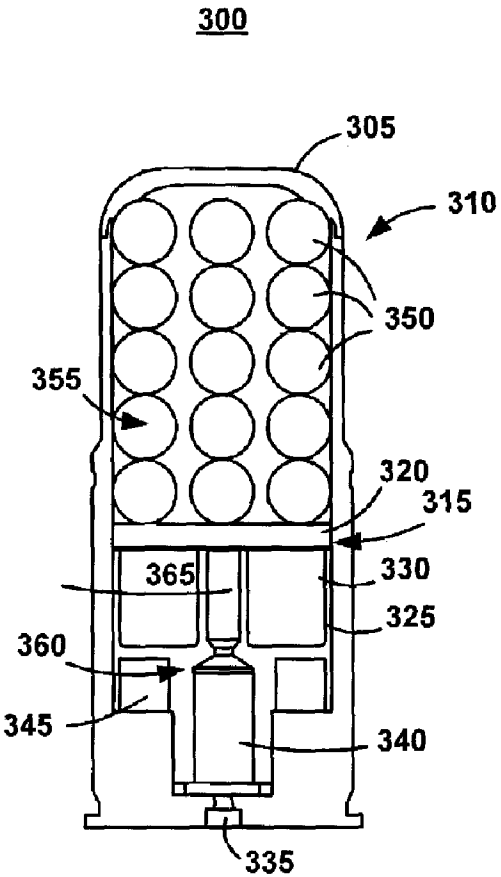

The various features of the present invention and the manner of attaining them will be described in greater detail with reference to the following description, claims, and drawings, wherein reference numerals are reused, where appropriate, to indicate a correspondence between the referenced items, and wherein:

FIG. 1 is a cross-section view of an exemplary small-caliber non-lethal ammunition of calibers 5.56 mm to 9 mm;

FIG. 2 is a cross-section view of an embodiment of a small-caliber non-lethal ammunition of calibers 5.56 mm to 9 mm; and FIG. 3 is a cross-section view of an exemplary non-lethal ammunition of calibers 9 mm to 40 mm. FIG. 1 is a cross-sectional view that depicts a non-lethal ammunition 100 comprising a cartridge 10 utilizing a dense powder ballast and a two-stage firing sequence according to the present invention. Cartridge 10 may be used, for example, as small caliber non-lethal ammunition of caliber 5.56 mm to 9 mm.

Cartridge 10 comprises a cartridge case 15, a ballast cup 20, an inner ballast sleeve 25, a dense powder ballast 30, an initial primer 35, a secondary primer 40, a propellant charge 45, and a non-lethal projectile 50. The non-lethal projectile may be made for example, of polymers, such as PVC, dense polymers, or filled polymers, with a thin wall that is made of a soft metal or a metal alloy, such as, for example, aluminum, or brass.

Cartridge case 15 comprises a soft metal or metal alloy such as, for example, brass. The outside surface of the cartridge case 15 has a diameter and roughness suitable for engaging the inside of a rifled barrel to induce spin. In addition, the roughness of the outside surface of the cartridge case 15 is sufficient to initiate wear and degradation on the cartridge case 15. This degradation facilitates disintegration of the cartridge case 15 once fired from the muzzle of the weapon, thus releasing the contents of the cartridge case 15. The cartridge case 15 is designed such that it can operate with or without rifling in the barrel of the weapon. The outer diameter of the case 20 is sized to match a full caliber ammunition cartridge, approximately matching the inside diameter of the weapon.

Non-lethal ammunition 100 utilizes a two-stage ignition system to launch the non-lethal projectile 50. The initial primer 35 at the base of cartridge 10 initiates the firing sequence when a firing pin of a weapon (not shown) impacts the initial primer 35. The secondary primer 40 is placed a short distance proximal to the initial primer 35. The Separating the initial primer 35 and the secondary primer 40 is a clear axial cylindrical space 55 surrounded by the propellant charge 45. The propellant charge 45 launches the dense powder ballast 30, providing sufficient recoil to operate the automatic or semi-automatic weapon.

Non-lethal projectile 50 comprises a bullet nose. The diameter of the non-lethal projectile 50 is less than the caliber of the firing weapon. The non-lethal projectile 50 comprises plastic to achieve a non-lethal impact and penetration depth at target. The non-lethal projectile 50 is connected to the secondary primer 40 by the inner ballast sleeve 25.

In operation of the non-lethal ammunition 100, a weapon firing pin (not shown) strikes the initial primer 35, delivering an impact sufficient to initiate a two-stage firing sequence. When struck by the firing pin, the initial primer 35 fires, pushing the inner ballast sleeve 25 forward to launch the non-lethal projectile 50. Concurrently, initial primer 35 sets off the firing of the secondary primer 40, which then initiates the firing of the propellant charge 45, resulting in the launch of the dense powder ballast 30. The dense powder ballast 30 is launched approximately 0.01 second to 0.5 second after the non-lethal projectile 50 is launched.

The non-lethal projectile 50 leaves the weapon muzzle (not shown) with a typical velocity range of 300 ft/sec to 400 ft/sec. The muzzle velocity of the non-lethal projectile 50 decreases to a non-lethal velocity at approximately 10 meters, the minimum engagement distance. The non-lethal projectile 50 has a total effective range of approximately 10 to 50 meters from the weapon muzzle (not shown). The trajectory of the non-lethal projectile 50 is flat, allowing use of standard rifle sights. The dense powder ballast 30 fires with sufficient impulse or momentum to recycle the reloading mechanism in automatic and semi-automatic weapons.

FIG. 2 illustrates a cross-section view of an embodiment of the non-lethal ammunition 100A with firing accomplished by the initial primer 35 and the secondary primer 40.

FIG. 3 is a cross-sectional view of further embodiment, depicting a dense powder ballast non-lethal cartridge 300 (also referenced herein as cartridge 300). Cartridge 300 may be used for large caliber non-lethal ammunition from 12 Gage to 40 mm used in weapons such as, for example, grenade launchers. Cartridge 300 comprises a front end cap 305, a cartridge case 310, a gas seal 315, a paper cover 320, a ballast cup 325, a dense powder ballast 330, an initial primer 335, projectile propellant charge 340, a weapon-powering propellant charge 345, and several non-lethal projectiles 350. The gas seal 315 and the paper cover 320 essentially divide the interior of the cartridge case 310 into a fore section 355 and an aft section 360. The gas seal 315 is airtight.

Cartridge 300 is substantially cylindrical in shape and comprises the front end cap 305 and the cartridge case 310. The cartridge case 310 is substantially cylindrical in shape and made of a metal or metal alloy such as, for example, aluminum, brass or steel. The outside surface of cartridge case 310 has a diameter and roughness suitable for engaging the inside of a rifled barrel to induce spin. Engaging the inside of the rifle barrel further initiates wear and degradation on the cartridge case 310, facilitating disintegration of the ballast cup 325 after exit from a weapon muzzle. After launch from a weapon and subsequent disintegration, the ballast cup 325 releases any contents contained within the ballast cup 325 such as, for example, the dense powder ballast 330.

In addition, the cartridge case 310 acquires spin after firing. As designed, the cartridge case 310 dissipates and disintegrates after leaving the muzzle, discharging the contents of the ballast cup 325. The muzzle velocity of the ballast cup 325 and contents of the ballast cup 325 decreases to a non-lethal velocity within approximately 5 meters from the muzzle.

Cartridge 300 can operate with or without rifling in the barrel of the weapon from which the cartridge 300 is fired. Cartridge 300 is a full caliber ammunition cartridge; i.e., the outer diameter of the cartridge case 310 is approximately the same as the inside diameter of the barrel.

Cartridge 300 utilizes a two-stage ignition system contained within the aft section 360 to deliver one or more non-lethal projectiles 350. The initial primer 335 initiates the firing sequence when impacted by a firing pin from a weapon (not shown). The projectile propellant charge 340 comprises a propellant for launching the non-lethal projectiles 350 and a container for the propellant. The projectile propellant charge 340 is separated from the initial primer 335 by a clear axial cylindrical space formed by the cartridge case 310. The weapon-powering propellant charge 345 comprises a propellant for firing the dense powder ballast 330 and a container for the propellant. The weapon-powering propellant charge 345 is seated in cartridge case 310 and is concentric to, but not in contact with, the projectile propellant charge 340.

The annular ballast cup 325 contains the dense powder ballast 330. The dense powder ballast 330 comprises, for example, tungsten powder, iron powder and iron oxide powder. The dense powder ballast 330 has a particle size range typically between 10 and 30 microns. The lower range limit of 10 microns is to minimize the potential of inhalation of ballast powder that may pose a health hazard. The higher range limit of 30 microns is to allow the dense powder ballast 330 particles to rapidly decelerate to an eye safe level. The ballast cup 325 is attached to a distal side of the cover 320. The cover 320 is substantially a plastic disk. The cover 320 keeps the dense ballast powder 330 in place while the non-lethal payload and projectile are being launched. Enclosed in the center of the cover 320 is a chamber 365 of the non-lethal projectile propellant charge 340.

The fore section 355 inside the cartridge case 310 is bounded by the front end cap 305 on one end and the gas seal 315 and the cover 320 on the other end. The fore section 355 is filled with non-lethal projectiles 350 to a high fill ratio with the non-lethal projectiles 350 in close proximity to one another. The non-lethal projectiles 350 may comprise, for example, 0.40 caliber rubber balls.

In operation of the non-lethal ammunition 300, a weapon firing pin (not shown) strikes the initial primer 335, delivering an impact of sufficient impulse to initiate a two-stage firing sequence. When struck by the weapon trigger, the initial primer 335 fires. After a time delay of less than approximately 1 second, the projectile propellant charge 340 initiates firing. Combustion gas products from the projectile propellant charge 340 fill the container of the projectile propellant charge 340, increasing pressure. The pressure pushes combustion gas products into chamber 365.

The hot combustion gas exits a high-pressure region in the chamber 365 to a lower pressure region in the fore section 355. Consequently, the hot combustion gas develops a high-low pressure signature that results in non-lethal impact at target. The high-low pressure signature improves consistency in muzzle velocity compared to conventional single-stage propulsion systems producing similar ballistics.

The hot combustion gases impart momentum to the non-lethal projectiles 350. The non-lethal projectiles 350 and front end cap 305 exit the weapon muzzle (not shown) with a velocity approximately 300 ft/sec to 400 ft/sec. The muzzle velocity of the non-lethal projectiles 350 decrease to a non-lethal velocity at the minimum engagement distance. The non-lethal projectiles 350 have a total effective range of approximately 10 to 50 meters from the weapon muzzle in typical 40 mm military applications.

Concurrently, the combustion gases from the delay projectile propellant charge 340 initiate the firing of the weapon-powering propellant charge 345. The weapon-powering propellant charge 345 launches the dense powder ballast 330. The weapon-powering propellant charge 345 fires approximately 0.01 second to 0.5 second after the projectile propellant charge 340 fires. Launching the dense powder ballast 330 provides sufficient impulse or momentum to recycle the reloading mechanism in automatic and semi-automatic weapons. As designed, the ballast cup 325 dissipates and disintegrates after leaving the muzzle, discharging the contents of ballast cup 325. The muzzle velocity of the ballast cup 325 and contents of the ballast cup 325 decreases to a non-lethal velocity within approximately 5 meters from the muzzle.

It is to be understood that the specific embodiments of the invention that have been described are merely illustrative of certain applications of the principle of the present invention. Numerous modifications may be made to a non-lethal projectile utilizing a dense powder ballast and a two-stage firing sequence described herein without departing from the spirit and scope of the present invention.

What is claimed is:

1. In an automatic or semi-automatic weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and;

wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy.

2. In an automatic or semi-automatic weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy; and wherein the ammunition further comprises a ballast cup that decomposes and disintegrates after exiting the muzzle end of the weapon after firing, within a pre-determined distance of the muzzle end, dispersing the plurality of projectile balls at the muzzle velocity.

3. In an automatic or semi-automatic smooth bore weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy; wherein the ammunition further comprises a ballast cup that decomposes and disintegrates within a pre-determined distance of exiting the muzzle end after firing, dispersing the plurality of projectile balls at the muzzle velocity, and wherein the ballast cup comprises a rotating band and a spiral to develop a spin in said ammunition upon firing thereof.

4. In an automatic or semi-automatic weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy; wherein the ammunition further comprises a ballast cup that decomposes and disintegrates within a pre-determined distance of exiting the muzzle end after firing, dispersing the plurality of projectile balls at the muzzle velocity; and wherein the ammunition further comprises an end cap, a polymer cover, and a gas seal; and wherein the polymer cover separates an interior of the cartridge case into a fore section and an aft section, with the ballast cup containing the ballast material in the aft section.

5. In an automatic or semi-automatic weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy; wherein the ammunition further comprises a ballast cup that decomposes and disintegrates within a pre-determined distance of exiting the muzzle end after firing, dispersing the plurality of projectile balls at the muzzle velocity; and wherein the ammunition further comprises an end cap, a polymer cover, and a gas seal; and wherein the polymer cover separates an interior of the cartridge case into a fore section and an aft section, with the ballast cup containing the ballast material in the aft section, and wherein the fore section contains the plurality of projectile balls.

6. In an automatic or semi-automatic weapon having a dense powder ballast and a firing sequence, and wherein a recoil impulse and gas pressure resulting from a launch of such dense powder ballast activates a reloading mechanism of the weapon, and wherein such weapon has a muzzle end thereof; a medium caliber ammunition for use in such weapon, said ammunition comprising:

projectile balls within said ammunition;

a projectile propellant charge for launching said projectile balls;

a propellant charge for launching said dense powder ballast, and wherein the projectile balls achieve a muzzle velocity within a predetermined distance of the weapon's muzzle, and wherein said ammunition further comprises: a cartridge case that is made, at least in part, of a material that is selected from the group consisting of metal and a metal alloy; wherein the ammunition further comprises a ballast cup that decomposes and disintegrates within a pre-determined distance of exiting the muzzle end after firing, dispersing the plurality of projectile balls at the muzzle velocity; and wherein the ammunition further comprises an end cap, a polymer cover, and a gas seal; and wherein the polymer cover separates an interior of the cartridge case into a fore section and an aft section, with the ballast cup containing the ballast material in the aft section, and wherein the aft section contains the primer, the projectile propellant charge, the weapon powering propellant charge, and the dense powder ballast.

* * * * *